US005145394A

United States Patent [19]

Hager

[11] Patent Number: 5,145,394

[45] Date of Patent: Sep. 8, 1992

[54] ANTI-ROTATION ASSEMBLY FOR INTERCONNECT DEVICES

[75] Inventor: Jeffrey J. Hager, Camarillo, Calif.

[73] Assignee: G & H Technology, Inc., Camarillo, Calif.

[21] Appl. No.: 770,319

[22] Filed: Oct. 3, 1991

[51] Int. Cl.[5] ..... H01R 13/623

[52] U.S. Cl. ..... 439/321

[58] Field of Search ..... 439/320-323, 439/315, 318

[56] References Cited

U.S. PATENT DOCUMENTS 2,728,895 12/1955 Quackenbush et al. ..... 439/321
3,594,700 7/1971 Nava .
3,786,396 1/1974 Kemmer et al. ..... 439/321
3,801,954 4/1974 Dorrell .
3,892,458 7/1975 Clark .
4,109,990 8/1978 Waldron .
4,165,910 8/1979 Anderson .
4,239,314 12/1980 Anderson .
4,268,103 5/1981 Schildkraut .
4,272,144 6/1981 Brush .
4,279,458 7/1981 Knapp .
4,291,933 9/1981 Kakaris .
4,359,254 11/1982 Gallusser .
4,407,529 10/1983 Holman .
4,484,790 11/1984 Schidkraut .
4,500,153 2/1985 Mattingly .
4,542,952 9/1985 Tomsa .
4,548,458 10/1985 Gallusser .
4,597,621 7/1986 Burns .
4,622,198 11/1986 Gallusser .
4,648,670 3/1987 Punako .
4,676,573 6/1987 Norman .
4,703,988 11/1987 Raux .
4,726,782 2/1988 Hager .
4,741,706 5/1988 Takeda .
4,793,821 12/1988 Fowler .
4,808,117 2/1989 Gale .
4,834,667 5/1989 Fowler .

*Primary Examiner*—Joseph H. McGlynn
*Attorney, Agent, or Firm*—Kenneth J. Hovet

[57] ABSTRACT

An axially oriented detent system interacting between a contact plug housing and a coaxial coupling ring. The coupling ring includes an inner peripheral rib that provides an axially outwardly facing shoulder. Detent springs or a detent washer with resilient detent elements engage the serrated face of a cover part. The cover part is secured to the sleeve so that the springs or elements move across the face during rotation of the coupling ring. The springs and elements have flexible arms that incline from a base apex to a distal free end. Movement of the serrations from the free end toward the apex creates a compression force that is absent when the serrations move in opposite direction. As such, the system creates a resistance to rotational decoupling that exceeds the resistance to coupling.

30 Claims, 6 Drawing Sheets

ANTI-ROTATION ASSEMBLY FOR INTERCONNECT DEVICES

BACKGROUND OF THE INVENTION

1. Field of the Invention

The present invention relates to multi-part connecting devices and, more particularly to improved detent mechanisms for resisting unwanted rotation in electrical connectors having a plug housing with a coupling ring.

2. Description of Related Art

In most situations, electrical connector assemblies are adequately held together by friction in the threaded components and the mating surfaces. However, in vehicle, aircraft and spacecraft applications, the connector assemblies are oftentimes subjected to severe vibrational forces. Such forces, over time, loosen the connections which may produce serious problems in operating the vehicle or craft.

To overcome the above problems, literally hundreds of devices have been developed to affirmatively secure together the electrical connector parts. For example, keys, pins and locks have oftentimes been used. But, the connection of such devices may have an adverse impact on the structural integrity and use of the assembly. Also, they are not suitable for use when the connectors are situated in inaccessible locations.

The use of resins, solders and mechanical locking rings are usually effective if it is desired to permanently lock the assembly together. However, most often it is preferred to be able to disconnect the assemblies for replacement or testing purposes.

Accordingly, a variety of devices have evolved that resist decoupling, but do not permanently prevent it. U.S. Pat. No. 4,407,529 describes a plurality of spring-loaded balls radially mounted in a coupling nut. The balls releasably engage spaced-apart depressions in the outer circumference of a plug housing. Spring tension creates resistance from dislodgement of the balls from the depressions which, thereby, inhibits unwanted rotation of the coupling nut.

A problem with the above arrangement is the balls and depressions must be engaged, i.e., aligned, to resist decoupling. However, this is difficult to achieve when constructing and assembling the connector parts. Additionally, maintenance costs are extremely high for such intricate devices.

Both U.S. Pat. Nos. 4,793,821 and 4,834,667 utilize a radially outwardly extending spring means for engaging teeth formed on the inside of a collar. Again, the difficulty and expense in forming a row of teeth about the interior periphery of a multiribbed collar, creates a very significant manufacturing disadvantage. Difficulties further arise in properly maintaining the spring positions, as they extend from flattened grooves on a sleeve, during placement of the sleeve within the collar.

In U.S. Pat. No. 4,359,254, a plastic coupling ring is placed adjacent a connector housing having an inner lip from which extend a series of ramps. The ring itself is provided with a plurality of deflectable fingers which slide over the ramps in one direction. However, when moved in an opposite direction, the fingers have difficulty in riding over the blunt ends of the ramps. This creates the desired anti-rotation resistance. Unfortunately, it also causes excessive wear and reduces the service life of the device.

Additionally, another significant disadvantage of the above device is the high cost and difficulty in molding undercut finger shapes about the interior surfaces of the coupling ring. Still further, if the fingers break or weaken, the entire ring will have to be replaced.

An improvement over the above system is shown in U.S. Pat. No. 4,542,95. This arrangement utilizes individual spring members, rather than fingers, which are integral with the coupling ring. The spring members are separately riveted to the inside of the ring to flexibly engage bayonet pins extending radially from the outer surface of a connector shell. The pins readily slide over the springs during rotational engagement of the coupling to the shell. However, greater resistance occurs when the coupling is rotated in the opposite direction.

A significant problem with the above system is its limited application. That is, electrical connections are not always made to a receptacle shell. In-line connections are common and it would be far more versatile to simply provide anti-decoupling means between the coupling part and its associated plug housing. Also, it is difficult and labor intensive to position and secure the bayonet pins in an external receptacle shell in precise coordination with springs on a coupling ring when the ring is part of a separate independent connector assembly.

SUMMARY OF THE INVENTION

In its basic form, the invention provides an anti-decoupling means between a cylindrical sleeve and an overlying coaxial ring. In an electrical connector context, the ring may comprise a coupling ring for securing an electrical contact plug to a corresponding contact insert in a receptacle shell.

The invention obviates many of the prior art problems by locating detent means for resisting decoupling on an axially facing shoulder of the coupling ring. This avoids the need for extraneous parts, difficult machining processes and laborious assembly steps.

The cylindrical sleeve, which can function as a housing for an electrical plug insert, is used to constrain and impress a cover part against the detent means. Such few parts allow for easy fabrication and uncomplicated assembly which lower costs and greatly enhance product reliability.

DESCRIPTION OF THE PREFERRED EMBODIMENTS

Figure 1:
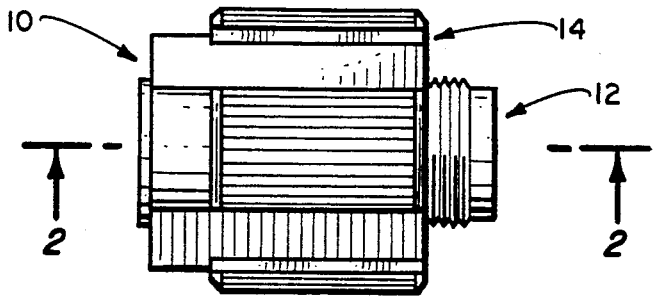
FIG. 1 is a side elevational view of a cylindrical sleeve and overlying ring assembled in accordance with the invention.
Figure 2:
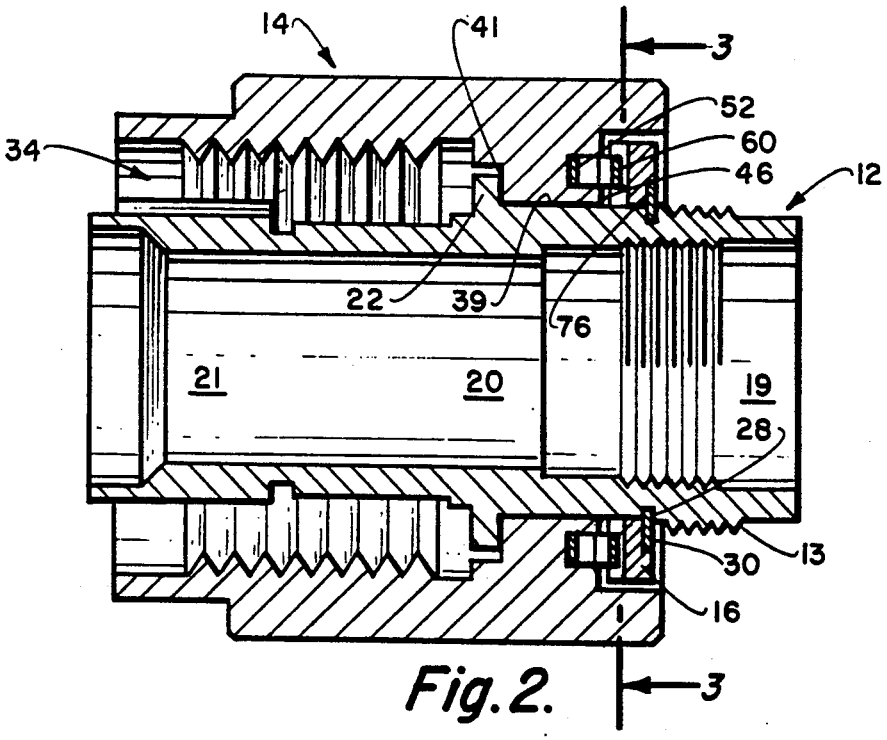
FIG. 2 is an enlarged cross-sectional view taken along lines 2—2 of FIG. 1.
Figure 3:
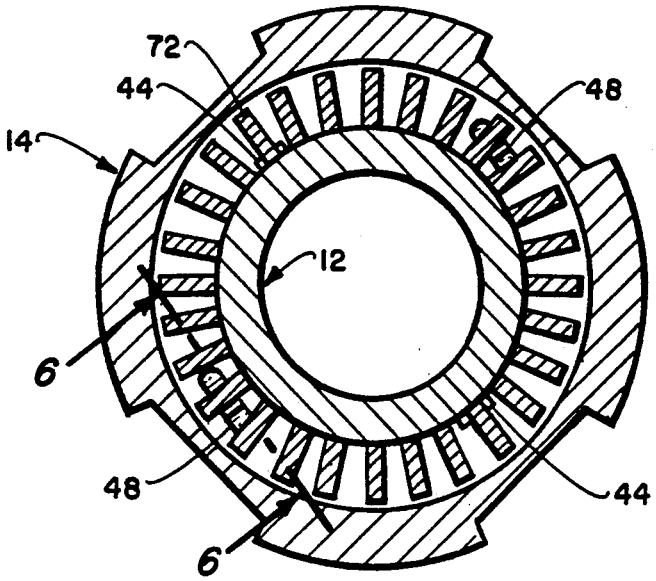
FIG. 3 is a cross-sectional view taken along lines 3—3 of FIG. 2.

With reference now to the drawings, the combined assembly of the invention is shown by reference 10 in FIG. 1. The basic parts of the assembly comprise a cylindrical sleeve 12, a coupling ring 14 and cover part 16. Interacting with the ring and cover part, to create rotational resistance, are detent means 18. Different versions of the detent means are illustrated in FIGS. 8, 9, 13 and 17–19.

In electrical connector applications, the sleeve will function as a housing for a contact plug insert (not shown). The sleeve has an outer end 19, a middle section 20 and an inner end 21. Proximate the middle section exterior is a radially extending flange 22. The flange preferably extends around the entire periphery of the housing.

Offset axially forward of the flange is a key part shown as projection 24. At least one key part is needed. However, it is preferred to have at least two diametrical projections for effecting a balance and evenness with the interfitting parts of the invention. (The second projection is hidden by the perspective view of FIG. 4.)

The axial circumferential distance between the flange and projection is defined as annular spacing 26. This spacing provides for the appropriate positioning of rotational interlocks for subsequent assembly of the coupling ring and cover part.

Outwardly adjacent the projections is an annular retention groove 28. The groove provides for releasable engagement of a corresponding split retainer ring 30 in a manner to be hereinafter discussed.

Rotatably overlying sleeve 12 is the coupling ring 14. The ring is in coaxial alignment with the sleeve and includes an interior open end section 34. The end section has an inner diameter greater than the diameter of inner end region 21 of the sleeve to allow ingress of an external connector part. The interior section is also threaded for engagement with corresponding threads on said connector part—such as the shell of an electrical receptacle (not shown).

The coupling ring has a front edge 36 which is recessed along inner wall 35 into an axially facing annular shoulder 38. The shoulder is part of abutment rib 40. It extends, in a direction about perpendicular to the coupling ring axis, to a rib inner diameter surface 39.

The radial length of the shoulder is predetermined so that rib inner diameter 39 is slightly greater than the outer diameter of the sleeve at spacing 26. Such inner diameter, however, is less than the outer diameter of radial flange 22. Also, the wall has a predetermined axial width that is slightly less than the spacing width. With the above relative dimensions, the spacing will function as a bearing surface for the inner surface 39. Additionally, the inner face 41 of the rib will provide an abutment and bearing surface for the aforesaid radial flange.

In order to rotatably interlock the coupling ring with the sleeve, the rib 40 is provided with keyways 44. The keyways comprise notches in surface 39 of the rib. They extend across the rib width and are located in the same number and radial position as the key parts 24.

Figure 4:
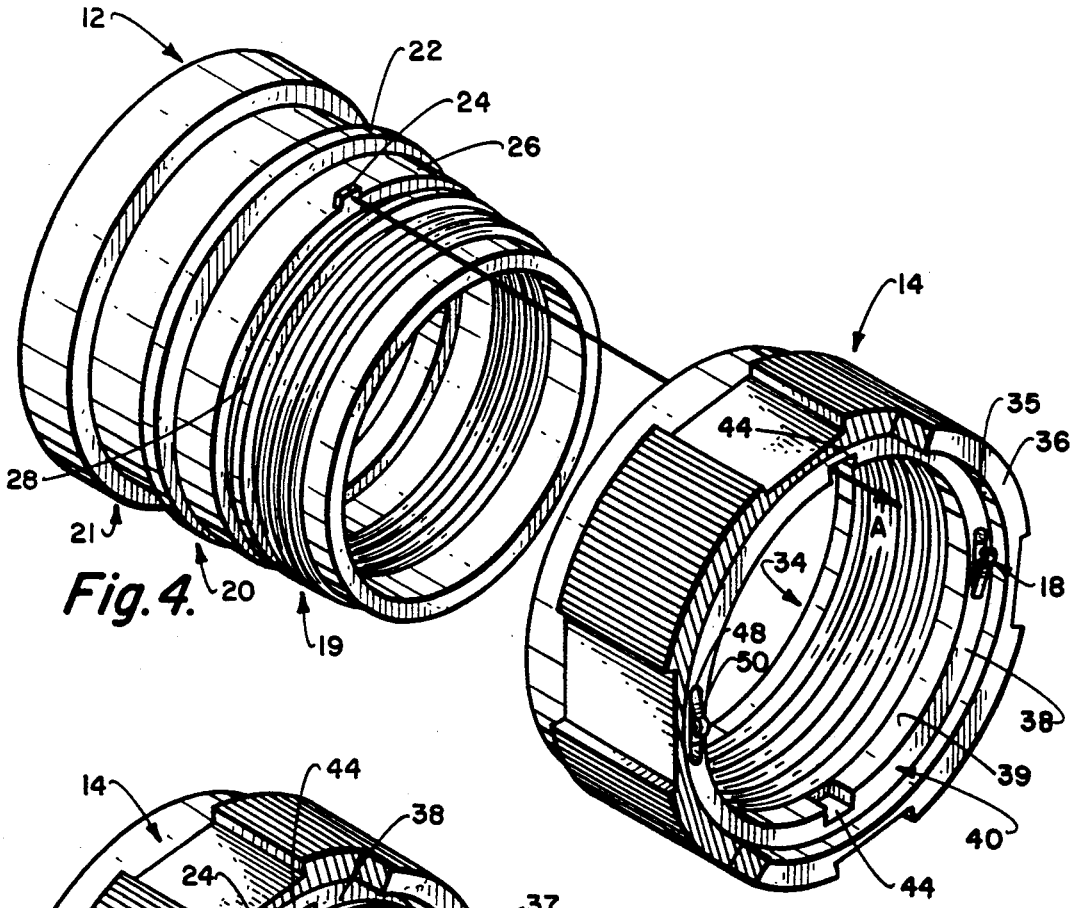
FIG. 4 is an enlarged exploded perspective view of the sleeve and ring of FIG. 1 with a part of the front edge of the ring broken-away.
Figure 5:
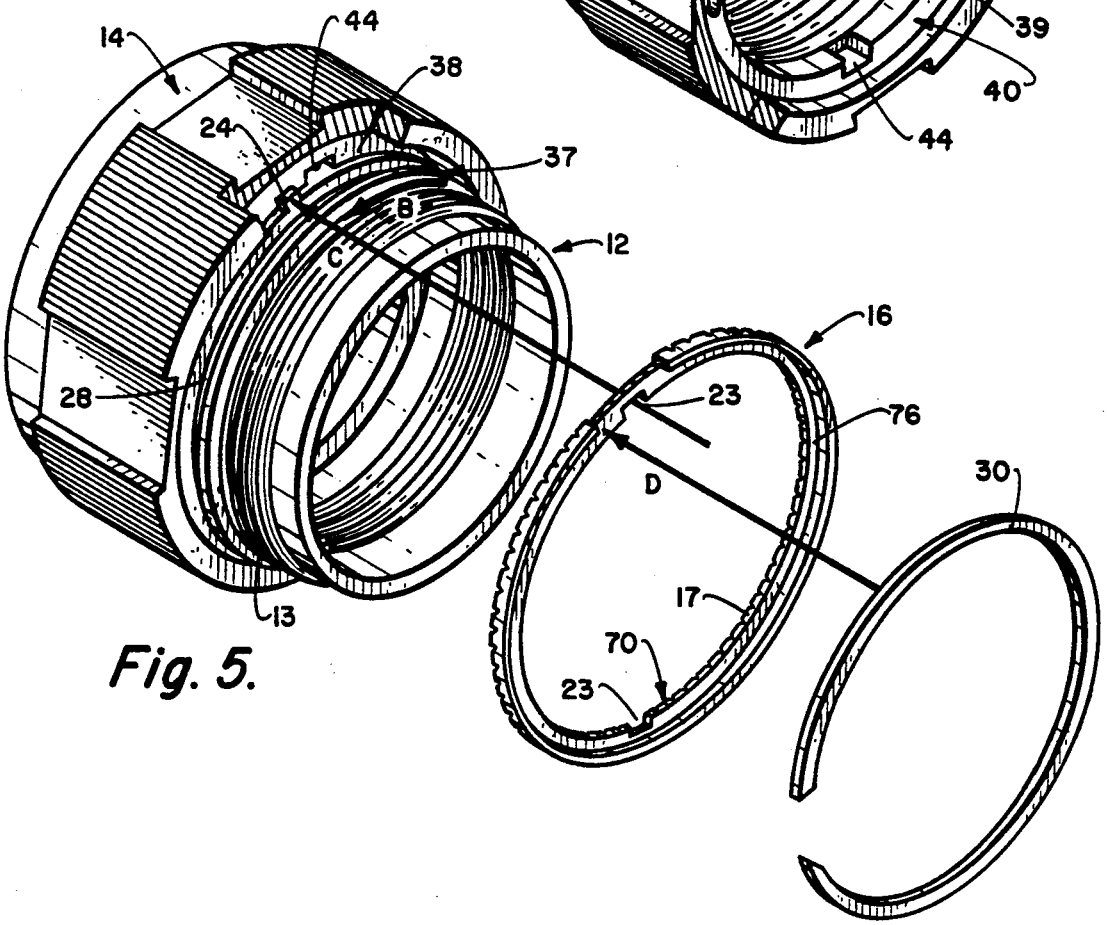
FIG. 5 is a perspective view showing the sleeve and ring of FIG. 1 assembled with a cover part and retainer ring exploded therefrom including key and keyway fragmentary cut-outs on the ring and cover part.

With particular reference to FIGS. 4 and 5, the coupling ring and sleeve are assembled by inserting sleeve outer end 19 into the open section 34 of the ring. This motion is shown by arrow A in FIG. 4. The sleeve key parts 24 are aligned with respective keyways 44 to allow further axial movement of the sleeve. Just as the key parts pass through and clear the keyways, radial flange 22 will abut against inner face 41 of the coupling peripheral rib 40. Mechanical interlock can now occur by relative rotation between the sleeve and ring as shown by arrow B. Such rotation will move the key parts away from the keyways and prevent axial separation.

The use of two diametrical interlock means are preferred for ease of assembly and symmetrical balance. It should also be noted that the key parts 24 have a radial extent less than the width, i.e., radial distance, of rib shoulder 38. This dimension provides clearance for placement of the detent means 18 and creates an unobstructed pathway 46 about a portion of the axial surface of the shoulder. It also facilitates connection with cover part 16 in a manner to be hereinafter described.

Figure 8:
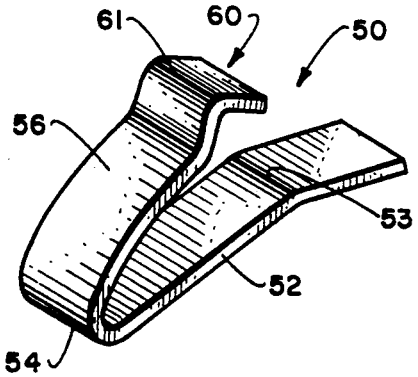
FIG. 8 is a right side front perspective view of the detent spring of FIGS. 6 and 7.
Figure 9:
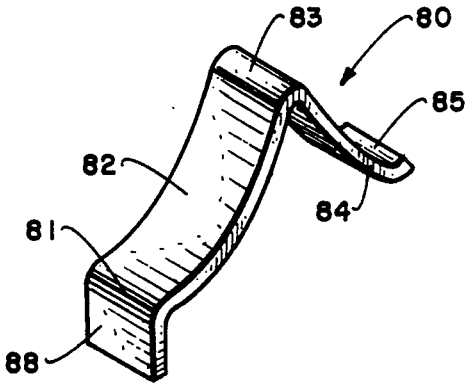
FIG. 9 is a right side front perspective view of an alternative arched detent spring suitable for use in the present invention.

With reference to FIGS. 4 and 8, the detent means is shown as bent-over spring 50. This spring consists of base portion 52 which merges into a bent section 54. The bent section forms the apex for an upwardly inclined detent arm 56. The arm extends from the apex back over a part of the base to a free end shown as end portion 60. The end portion is an arcuate structure and presents an upwardly facing convex surface 61. As a result of the detent arm's outwardly axial position and flexural characteristics, the convex surface will be continuously biased against the undulating, somewhat conformal, detent surface 70.

With reference to FIGS. 6–11 and 14, the detent surface or serrated face 70 is located on the inner axially-facing side of cover part 16. In the embodiment shown, it comprises a serrated surface consisting of grooves 71 and ridges 72. The grooves are adapted to physically receive end portion 60 and the ridges 72 are structured to deflect the end portion out of the grooves. The above actions result from relative movement between the serrations and the end portion.

It can be appreciated that the detent means may be radially staggered, i.e., have respective centerlines which are radially offset from each other. This feature reduces wear by allowing more area of the serrated face 70 to be frictionally engaged with the detent means.

Preferably, the grooves and ridges are radially aligned with the center axis of the overall assembly. Also, it is preferred that they are uniformly spaced-apart about the entire face and are uniform in size and cross-sectional shape.

As best shown in FIG. 5, cover part 16 has a narrow ring-like structure having inner and outer diameters in correspondence with the respective diameters of shoulder 38. This allows it to closely fit within the offset front opening 37 of the coupling ring and directly overlie the rib shoulder.

The cover part inner diameter is defined by inside edge 17. The edge is provided with a least one edge notch 23 which has an outline corresponding to the profile of key part 24. As illustrated by arrow C in FIG. 5, the notch and key part are aligned and become engaged as the serrated face is pressed against the outwardly directed resilient force of the detent spring.

The edge notch and key part provide a mechanical securement means for preventing rotational movement between the cover part and cylindrical sleeve 12. In other words, the cover part will always rotate in unison with the cylindrical sleeve.

When the cover part is pressed in place over shoulder 38, it will be located axially inward from edge 36 of ring 14 and the accessory threads 13 of sleeve 12. In this position, releasable retention means, shown as split retainer ring 30, can be spread-apart and positioned into retention groove 28.

As depicted by arrow D in FIG. 5, the retainer ring will also nest within annular indentation 76 of the cover part outer face. This is to prevent dislodgement of the cover part during vibration of the connector assembly. Since the ring engages both the retention groove and indentation 76, the cover part will be evenly held against the detent spring. This facilitates a uniform deflection of the detent spring end portions.

Although one detent spring will work, the detent means preferably comprises two or more detent springs for a balanced symmetry and resistance. The deflector portion of each spring should be in direct synchronization with a corresponding ridge or groove of the serrated face. This alignment will help to insure that the deflectable portions will move in unison.

Detent means useful with the invention are shown in FIGS. 6–19. Preferably, the detent means and associated detent surface create greater resistance to decoupling rotation than to coupling rotation.

Figure 6:
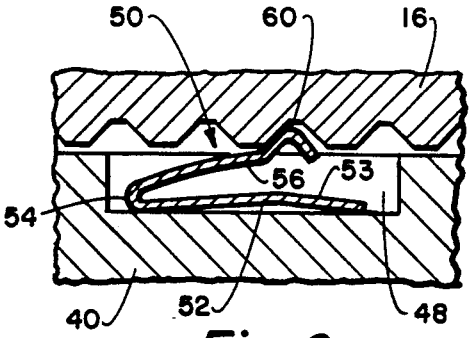
FIG. 6 is an enlarged fragmentary cross-sectional view taken along lines 6—6 of FIG. 3 showing the free end of a detent spring in the groove of a detent face.
Figure 7:
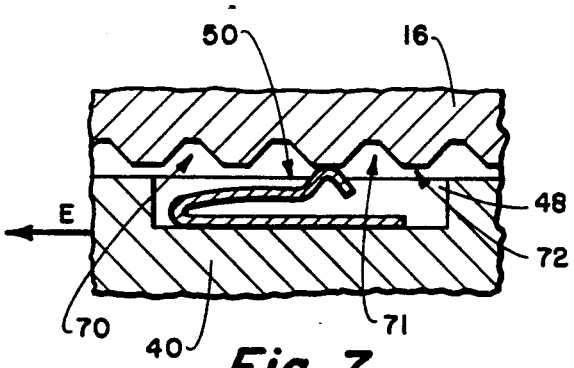
FIG. 7 is a view similar to FIG. 6 showing the free end in a deflected position upon a ridge of the detent face.

The previously described bent-over spring 50 is shown in detail in FIGS. 6–8. In FIG. 6, the spring is depicted as being only nominally stressed (deflected) with its free end confined by groove 71. Upon rotation of the coupling ring in the coupling direction of arrow E (FIG. 7), the spring will move relative to the serrations beginning from the spring apex to the spring free end. Such movement will allow the free end to successively move into and out of passing grooves.

The force required to deflect the free end out of each groove, plus the surface friction from engagement of convex surface 61 and the detent surface, including friction from all other bearing surfaces, create a predetermined total resistance against rotation of the ring.

Note that optional base portion crease 53 may flatten during deflection. This action may also supplement the above deflection force.

When the detent spring is moved with the ring in an opposite decoupling direction across the detent face, the identical deflection action will occur. However, since this direction is opposite the acute angle of the detent arm, the leverage effect of the arm length will be, initially, at least partially ineffective.

Also, a detent arm compression force will occur when the free end first impinges upon a ridge. The net result is that substantial additional forces will be added to the deflection and friction forces. As such, the overall resistance will be substantially increased. With the above in mind, the detent spring(s) should be aligned to create the lower level of resistance in the rotational direction of coupling and the higher level in the decoupling direction.

Figure 12:
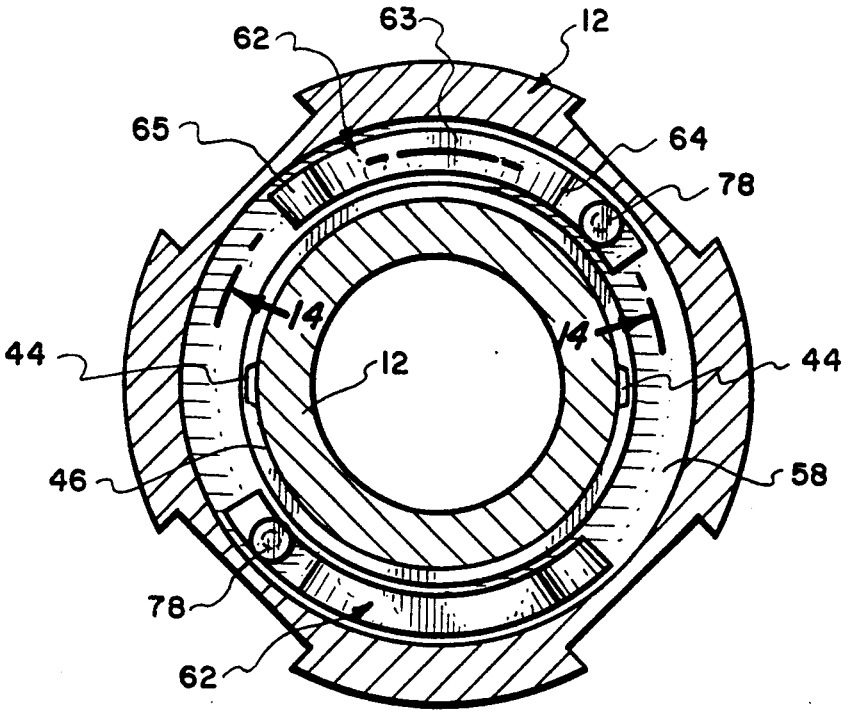
FIG. 12 is a cross-sectional view of the end of an alternative coupling ring having an annularly recessed shoulder area to which are attached two alternative curved detent springs.
Figure 13:
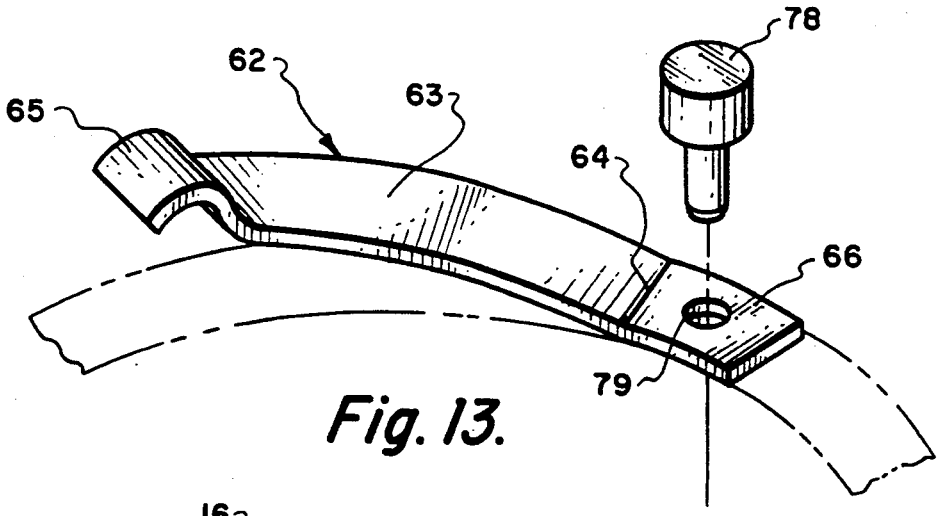
FIG. 13 is an enlarged perspective view illustrating one of the detent springs shown in FIG. 12.
Figure 14:
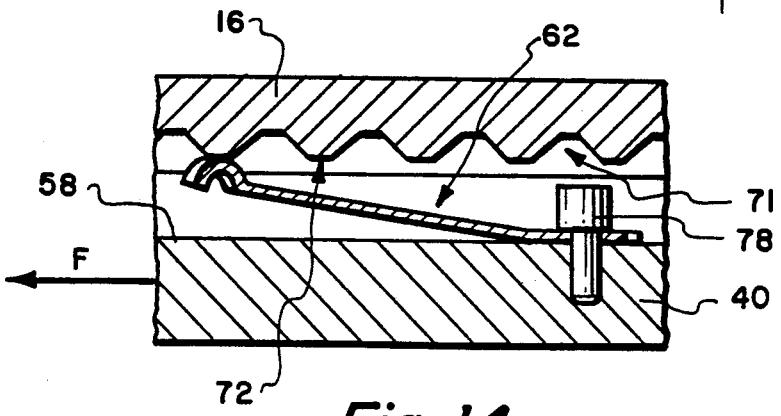
FIG. 14 is a fragmentary cross-sectional view taken along lines 14—14 of FIG. 12.

A curved detent spring 62, similar to the aforementioned, is shown in FIGS. 12–14. In this embodiment, the outer portion of shoulder 38 is recessed about its entire circumference between pathway 46 and inner wall 35. Within this recessed annular area 58 are secured one or more of the curved detent springs. Each spring comprises a helically curved arm 63 which extends upwardly and around from base apex 64. The curvature of the arm should be about equal to the curvature of shoulder 38. This provides effective registration of the spring with the detent surface 70.

The detent arm terminates at a free end shown as distal end cap 65. The cap is substantially identical in structure to end portion 60 and is likewise functionally equivalent thereto. Extending rearward from the base apex is mounting base 66. This is a short flat section of the spring to provide a means for securement to the recessed area 58. Fastening means shown as peg 78 is used in a well known manner to secure the base, through orifice 79, to shoulder 38.

Although one spring could be used, it is preferred to utilize at least two of the curved detent springs as shown in FIG. 12. They should be positioned in the same orientation and for the same purposes as described with respect to the bent-over springs.

When the coupling ring and springs are rotated in a decoupling direction, as shown by arrow F in FIG. 14, end cap 65 will incur an initial compression force upon its impingement with a ridge 72. This force will be added to the force of deflection to create a decoupling resistance. Such resistance is greater than the coupling resistance whereby the opposite rotation only creates deflection forces.

An advantage of the curved springs is that they are more affirmatively connected to the rib shoulder. This provides reliability and avoids misplacement of the springs in an opposing or reversed alignment.

Figure 10:
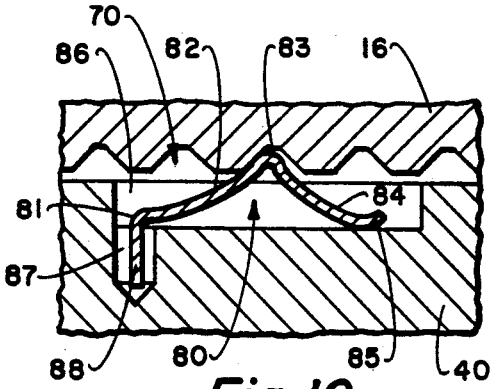
FIG. 10 is a view similar to FIG. 6 showing the detent spring of FIG. 9 in an unstressed position.
Figure 11:
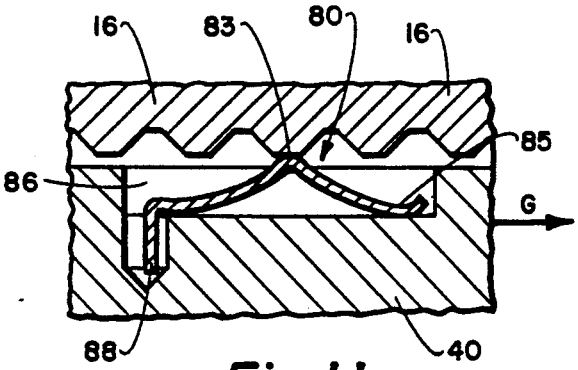
FIG. 11 is a view similar to FIG. 10 showing the arched detent spring in a deflected position.

In FIGS. 10 and 11, an arched detent spring 80 is illustrated. It includes a tab apex 81 from which extends an arcuate detent arm 82. The arm curvalinearally extends upwardly to a crest 83 which functions as the previously described free end.

Sloping downwardly and outwardly in a curvalinear fashion from the crest is support arm 84. The support arm terminates at a loose distal end 85. The overall spring is constrained in recess 86 which includes an additional bottom recess 87. A tab 88 extends downwardly from apex 81 into the bottom recess for a unidirectional linear restraint.

In operation, as the crest is deflected, both the detent arm and support arm will be partially flattened. Less force will be required for a coupling movement (from crest 83 toward distal end 85) because the loose end is free to reciprocate within the confines of the recess 86. In the opposite decoupling direction, as shown by arrow G in FIG. 11, compression forces along the support arm 82 will occur because the arm is constrained against movement by the tab 88 in bottom recess 87.

Figure 15:
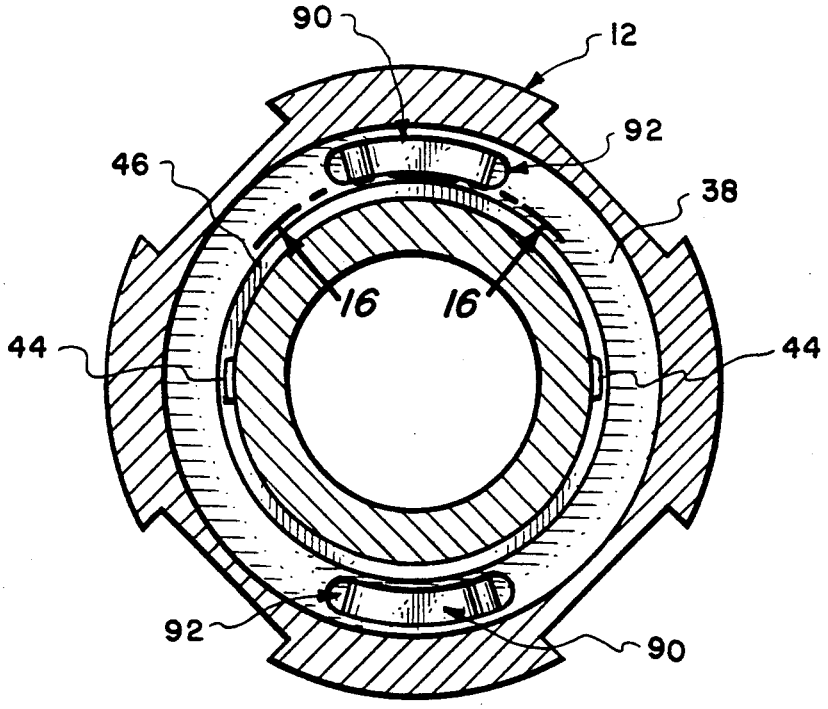
FIG. 15 is a cross-sectional view of the end of another alternative coupling ring where the shoulder is provided with curved pocket recesses for securement of curved bent detent springs.
Figure 16:
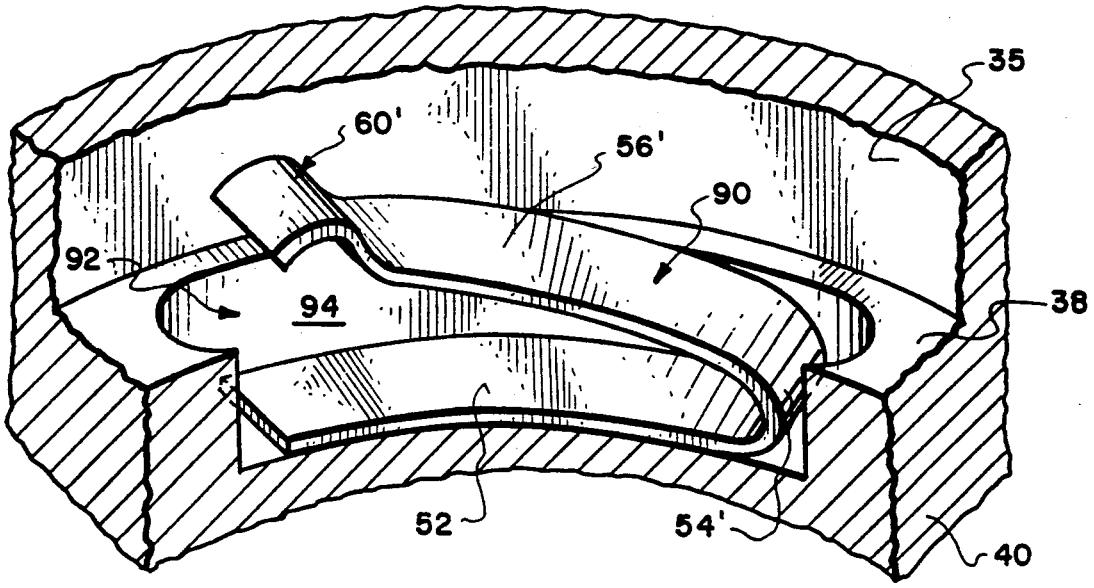
FIG. 16 is an enlarged fragmentary cross-sectional view taken along lines 16—16 of FIG. 15.

In FIGS. 15 and 16, detent means similar to bent-over spring 50 is shown as radius spring 90. In the this spring, radius base portion 52' merges into bent transition section 54'. This section forms an apex for upwardly extending radius arm 56'. The radius base portion and arm have the same radius of curvature which, in turn, closely corresponds to the curvature of opposing sidewalls 94 of curved recess 92. This close conformance prevents spring looseness and eliminates the need for additional securement means. It also prevents improper orientation and misalignment of the spring during assembly. The curved recess has a depth less than the overall height of the spring. In this way, a major portion of arm 56' will extend above shoulder 38.

As with bent-over spring 50, arm 56' terminates at a distal free end 60'. This end has a structure and function similar to end portion 60.

It is preferred that all of above-described detent springs be constructed of a flat strip of flexible material such as metal or plastic. Such materials are resistant to corrosion and their flexural characteristics can be readily determined and controlled during manufacture. Such information is important since the springs set the basic rotational resistance for the particular interconnect device being used.

Figure 17:
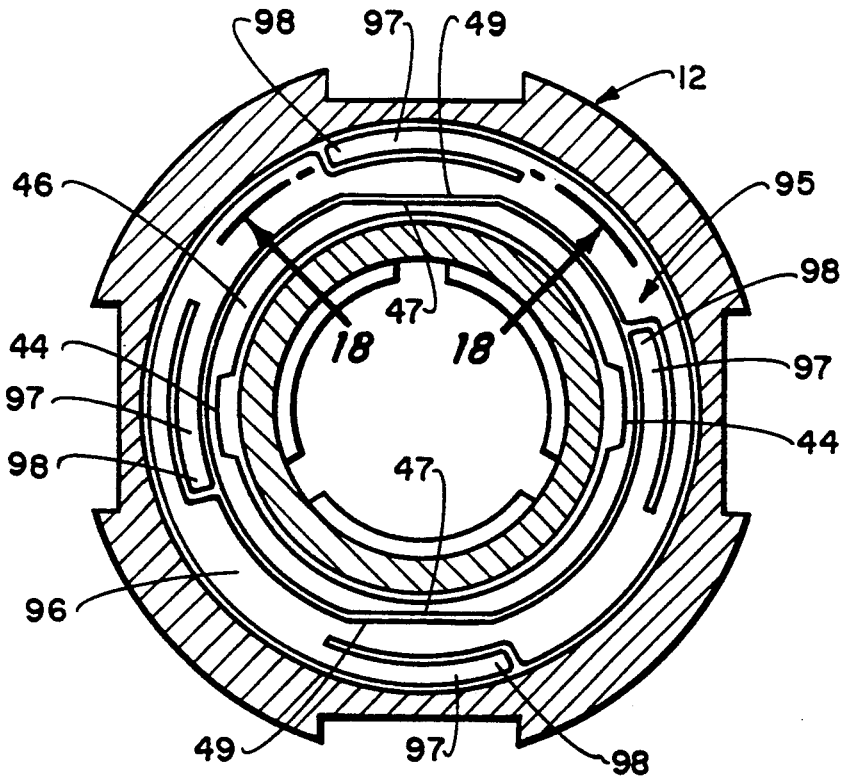
FIG. 17 is a cross-sectional view of the end of still another alternative coupling ring wherein the shoulder is provided with an annular recess within which is positioned a detent ring.
Figure 18:
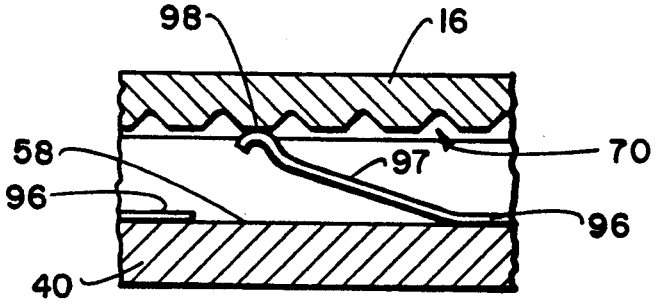
FIG. 18 is an enlarged fragmentary cross-sectional view taken along lines 18—18 of FIG. 17.
Figure 19:
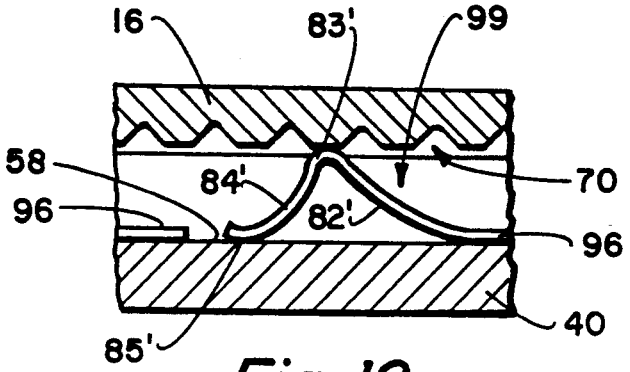
FIG. 19 is a view similar to FIG. 18 showing an alternative arched detent element.

In FIGS. 17–19, an alternative detent means is presented. In this embodiment, a detent ring 95 is used in place of the curved detent springs 62 which are shown in FIG. 12.

The detent ring comprises a flat washer-like structure which fits within annular area 58. Inclined upwardly from the washer body 96 are resilient deflector elements. With reference to FIGS. 17 and 18, curved arm elements 97 are shown which are similar to the curved detent spring 62 except they extend from the washer body and comprise cut-out portions thereof. They incline upwardly to an arcuate free end 98 which continuously engages the serrated face 70.

In FIG. 19, an alternative arched deflector element 99 is shown. This element is similar to arched detent spring 80 wherein curved arm 82' extends from body 96 to an abutment crest 83'. Outer arm 84' slopes downwardly from the crest to a loose free end 85'.

To connect the detent ring to the coupling ring and insure that both rings move together, various connector means known in the art may be used. Typical examples would be pegs, tabs, keys and associated indents. As shown, opposing inner faces of pathway 46 are provided with flat areas 47. Corresponding flattened edges 49 on the detent ring engage the flat areas and function to prevent relative rotation between the coupling ring and detent ring.

The above deflector elements may be spaced-apart, oriented, aligned and have the same shapes as the previously described detent springs. They also may have the same flexural characteristics. In this way, the overall detent ring will provide the desired overall resistance to decoupling in the same manner as the detent springs.

While the invention has been described with respect to preferred embodiments, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

I claim:

1. In a decoupling resistant electrical connector comprising:

a cylindrical plug housing having a flange about its outer periphery;

a coupling ring rotatably overlying said housing with an abutment rib about the ring inner periphery, said rib having an axially inwardly facing wall in abutment with said housing flange and an axially outwardly facing shoulder;

a detent means connected to said shoulder and extending axially outward therefrom;

a cover part connected against rotational movement to said housing having a serrated surface impressed against said detent means, said detent means providing resistance to movement across said serrated surface when said coupling ring is rotated.

2. The connector of claim 1 wherein said detent means comprises a detent arm inclining upwardly to a crest with a support arm declining downwardly and outwardly from said crest.

3. The connector of claim 1 wherein said detent means comprises a detent spring that includes a detent arm with a free end that engages said serrated surface.

4. The connector of claim 3 wherein said detent arm inclines upwardly in the direction of coupling rotation from a base portion which is connected to said shoulder.

5. The connector of claim 4 wherein said serrated surface includes a series of grooves and said free end comprises a convex structure which is deflectably engageable with any one of said grooves.

6. The connector of claim 5 wherein said grooves are uniformly spaced-apart and radially aligned, including two spaced-apart detent springs identically aligned with respective free ends in simultaneous engagement with corresponding grooves.

7. The connector of claim 5 wherein said detent spring comprises a strip of resilient material bent to form an apex between said base portion and detent arm.

8. The connector of claim 7 wherein said detent arm has a radius of curvature proximate to the radius of curvature of said shoulder.

9. The connector of claim 7 wherein said shoulder includes at least one recess to constrain said detent spring, said base portion being positioned within said recess and extending beneath said detent arm.

10. The connector of claim 1 wherein said detent means comprises a detent ring having at least one resilient upwardly inclined detent element which terminates at a free end for engagement with said serrated surface.

11. The connector of claim 10 including an annular recessed area about an outer portion of said shoulder, said detent ring being positioned within said recessed area: and, connector means for preventing relative rotation between said detent ring and said coupling ring.

12. A cylindrical anti-decoupling assembly comprising:

a cylindrical sleeve;

a coupling ring overlying said sleeve and rotatably engaged therewith, said ring having an inner rib forming an axially facing annular shoulder;

a detent means constrained at said shoulder and extending axially outward from said shoulder, said detent means including a flexible detent arm inclined from an apex in the direction of coupling rotation of said ring;

a cover part corresponding in shape to said shoulder having a serrated face impressed against said detent means, said cover part being constrained against rotation relative to said sleeve.

13. The assembly of claim 12 wherein said detent arm inclines upwardly to a crest with a support arm inclining down and outwardly from said crest.

14. The assembly of claim 12 including a base portion extending from said apex, said shoulder having a recess for constraining said base portion.

15. The assembly of claim 14 wherein said base portion extends beneath said detent arm.

16. The assembly of claim 12 including a base portion extending outwardly along said shoulder from said apex; and, a fastening means for securing said base portion to said shoulder.

17. The assembly of claim 16 said detent arm has a curvature about the same as said annular shoulder.

18. The assembly of claim 12 wherein said detent arm inclines to a free end comprising a convex structure, said serrated face including uniformally spaced-apart grooves sized to receive said structure and corresponding ridges aligned to deflect said structure.

19. The assembly of claim 18 including two detent means identically aligned in spaced-apart positions on said shoulder so that the respective convex structures simultaneously engage corresponding grooves.

20. In an electrical connector, comprising:

a cylindrical plug housing having a peripheral flange and a key part axially offset from said flange;

a coupling ring with an inner peripheral abutment rib, said rib forming an axially outwardly facing annular shoulder with a keyway corresponding to said key part extending across said rib;

detent means stationarily constrained to said shoulder comprising a flexible detent arm with a free end positioned axially outward from said shoulder;

an annular cover part overlying said shoulder having a serrated face with grooves adapted to receive said free end;

retention means for impressing said face against said free end; and, securement means for preventing rotation of said part relative to said plug housing.

21. The connector of claim 20 wherein said plug housing has an outer end and an inner end, said key part being closer to said outer end than said peripheral flange.

22. The connector of claim 21 wherein the axial width of said rib is slightly less than the spacing between said key part and said flange.

23. The connector of claim 22 wherein said spacing defines an annular surface having a diameter slightly less than the inner diameter of said abutment rib.

24. The connector of claim 23 wherein said key part comprises at least one projection extending radially outward from adjacent said annular surface.

25. The connector of claim 24 wherein said keyway comprises at least one notch defining an opening sufficient to allow said projection to pass through and engage said shoulder upon rotation of said plug housing relative to said coupling ring.

26. The connector of claim 24 wherein said cover part comprises a ring structure that is coextensive with said shoulder, said ring structure having a central opening defined by an inside edge.

27. The connector of claim 26 wherein said inside edge includes at least one edge notch corresponding in outline to the profile of said projection whereby engagement of said projection with said edge notch comprises said securement means.

28. The connector of claim 27 wherein said plug housing includes an annular groove about the periphery thereof adjacent to a side of said projection proximate said outer end, said retention means comprising a retainer ring releasably engaged in said groove and overlying said cover part.

29. The connector of claim 20 wherein said detent arm includes a base portion which is constrained to said shoulder and said arm inclines upwardly from said base portion.

30. The connector of claim 29 wherein said free end is spaced-apart from said base portion in a coupling direction to create less resistance to movement thereover in a coupling direction than in an opposite decoupling direction.

* * * * *